US005557160A

United States Patent [19]

Makishima et al.

[11] Patent Number: 5,557,160

[45] Date of Patent: Sep. 17, 1996

[54] FIELD EMISSION CATHODE INCLUDING CYLINDRICALLY SHAPED RESISTIVE CONNECTOR AND METHOD OF MANUFACTURING

[75] Inventors: Hideo Makishima; Akihiko Okamoto, both of Tokyo, Japan

[73] Assignee: NEC Corporation, Japan

[21] Appl. No.: 365,570

[22] Filed: Dec. 28, 1994

[30] Foreign Application Priority Data

Dec. 28, 1993 [JP] Japan ..... 5-336297

[51] Int. Cl.[6] ..... H01J 1/30; H01J 17/06

[52] U.S. Cl. ..... 313/336; 313/309; 313/497; 445/24

[58] Field of Search ..... 313/336, 306, 313/309, 497, 351, 308; 315/169.3, 169.4; 445/49, 24

[56] References Cited

U.S. PATENT DOCUMENTS

| | | | |
|---|---|---|---|
| 4,575,765 | 3/1986 | Hirt | 313/309 |
| 4,940,916 | 7/1990 | Borel et al. | 313/306 |
| 5,162,704 | 11/1992 | Kobori et al. | 313/309 |
| 5,371,431 | 12/1994 | Jones et al. | 313/336 |
| 5,451,830 | 9/1995 | Huang | 313/336 |

FOREIGN PATENT DOCUMENTS

| | | | |
|---|---|---|---|
| 57-56384 | 4/1982 | Japan | C04B 35/58 |
| 63-122161 | 5/1988 | Japan | H01L 27/06 |
| 4100239 | 4/1992 | Japan | H01L 21/331 |
| 4249026 | 9/1992 | Japan | H01L 1/30 |
| 536345 | 2/1993 | Japan | H01J 9/02 |
| 547296 | 2/1993 | Japan | H01J 1/30 |
| 594760 | 4/1993 | Japan | H01J 1/30 |

OTHER PUBLICATIONS

Pp. 3504 to 3505 of "J. Applied Physics, vol. 39, No. 7".

*Primary Examiner*—Michael Horabik
*Assistant Examiner*—Michael Day
*Attorney, Agent, or Firm*—Ostrolenk, Faber, Gerb & Soffen, LLP

[57] ABSTRACT

A high resistance epitaxial layer is formed on a substrate, and a resistance layer is formed for each emitter by injecting ions into the high resistance epitaxial layer via an aperture formed through a gate electrode. An emitter is provided on the resistance layer. Alternatively, ions are injected into a semiconductor substrate of a first conductivity type to provide a region of a second conductivity type opposite to the first conductivity type in the semiconductor substrate by using a gate electrode having an aperture as a mask. An emitter is provided on the region of the semiconductor substrate.

1 Claim, 4 Drawing Sheets

FIELD EMISSION CATHODE INCLUDING CYLINDRICALLY SHAPED RESISTIVE CONNECTOR AND METHOD OF MANUFACTURING

FIELD THE INVENTION

The invention relates to a field-emission cathode and a method for fabricating the same, and more particularly to, a field-emission cathode for emitting electrons from a sharpened tip thereof and a method for fabricating the same.

BACKGROUND OF THE INVENTION

A field-emission cathode in which fine field-emission cathodes each comprising a fine cone-shaped emitter, and a gate electrode formed in the immediate vicinity of the emitter to draw a current from the emitter and control the current are arranged in an arrayed pattern has been proposed on pages 3504 and 3505 of "Journal of Applied Physics, Vol. 39, No. 7, June 1968". This is defined a field-emission cathode of Spindt type, and has advantages in which a current density is obtained to be higher than that of a thermal cathode, and a velocity dispersion of emitted electrons is small. Further, the field-emission cathode has advantages in that current noise is small as compared to a single field-emission emitter, an operation voltage is as low as several tens to 200 V, and it operates even under a condition of relatively low vacuum degree.

A first conventional field-emission cathode which is Spindt type is described in the U.S. Pat. No. 4,940,916, a second conventional field-emission cathode is described in the Japanese Patent Kokai No. 4-249026, a third conventional field-emission cathode is described in the Japanese Patent Kokai No. 5-47296, and a fourth conventional field-emission cathode is described in the Japanese Patent Kokai No. 5-94760. The details of the first to fourth conventional field-emission cathodes will be explained later.

On the other hand, a conventional method for fabricating a field-emission cathode is described in the Japanese Patent Kokai No. 5-36345. The details of the conventional method for fabricating a field-emission cathode will be also explained later.

In general, the electron-emission property of a field-emission cathode depends largely on a structure. For instance, when a tip position of an emitter is displaced relative to a gate electrode by 1%, a current emitted from the emitter changes by approximately 5%. In order to unify currents emitted from a plurality of emitters, therefore, a height of an emitter, a curvature radius of an emitter tip, a thickness of an insulating layer, a thickness of a gate electrode, an aperture diameter of a gate electrode, etc. must be highly precise in the fabrication of a field-emission cathode. However, the providing the uniformity of current-emission makes the fabrication condition extremely severe and substantially lowers fabrication yield.

In order to overcome such disadvantages, it is proposed in the first to third conventional field-emission cathodes that a resistance layer or a non-linear device be positioned below an emitter to unify an emission current.

However, there are disadvantages in the first to fourth conventional field-emission cathodes and the conventional method for fabricating a field-emission cathode, as set out below.

In the first conventional field-emission cathode, interference among emitters occurs to make it difficult that an emission current is controlled individually for each emitter, when intervals among the emitters are made narrow to increase a density of the emitters, because a resistance layer is not independent for each emitter.

In the second conventional field-emission cathode, emission currents are dispersed dependent on the fluctuation of structures, before an emission current of each emitter reaches a level for operation of a current constant device. Therefore, the second conventional field-emission cathode is not suitable to be applied to the use in which all emission currents obtained by the cathode are changed or modulated. Further, it is necessary to align an exposing mask with positions of a current-constant device and a gate electrode aperture. Therefore, an exposure apparatus of high precision must be provided in fabricating a field-emission cathode with emitters of a high density.

In the third conventional field-emission cathode, the maximum resistance value is limited to approximately 200 KΩ, because a resistance layer is composed of a composite material including a metal, and the resistance layer is a part of an emitter. For this structure, current-limitation is not sufficient for a small emission current.

In the fourth conventional field-emission cathode, interference among emitters occurs due to the structure in which emitters are provided on a common resistance layer of tantalum oxide.

In the conventional method for fabricating a field-emission cathode, it is impossible to select a material for an emitter which is most suitable for a current emission property, because the emitter material is limited to silicon. Further, it is difficult to make a gate aperture diameter and an emitter interval small due to the fabrication process.

SUMMARY OF THE INVENTION

Accordingly, it is an object of the invention to provide a field-emission cathode and a method for fabricating the same in which an emission current is effectively controlled for each emitter.

It is a further object of the invention to provide a field-emission cathode and a method for fabricating the same in which there is no limitation on application, and no exposing apparatus is provided with high precision.

It is a still further object of the invention to provide a field-emission cathode and a method for fabricating the same in which an emitter is not limited to use a specific material.

It is a yet still further object of the invention to provide a field-emission cathode and a method for fabricating the same in which a current-limitation effect is obtained in a wide range of an emission current value.

According to the first feature of the invention, a field-emission cathode, comprises:

- a semiconductor substrate;
- a high resistance semiconductor layer formed on the semiconductor substrate;
- an electrode for emitting electrons, the emitting electrode being provided on the high resistance semiconductor layer and having a sharpened tip;
- an insulating layer formed on the high resistance semiconductor layer, the insulating layer having a cavity surrounding the emitting electrode; and
- a control electrode provided on the insulating layer, the control electrode having an aperture surrounding the emitting electrode;

wherein an impurity concentration of the high resistance semiconductor layer is higher in a region under the emitting electrode than in a remaining region of the high resistance semiconductor layer.

According to the second feature of the invention, a method for fabricating a field-emission cathode, comprises the steps of:

forming a high resistance semiconductor layer, an insulating layer, and a gate electrode successively on a semiconductor substrate;

forming a cavity extending through the gate electrode and the insulating layer;

injecting ions into the high resistance semiconductor layer by using the gate electrode formed with the cavity as a mask, thereby providing a high impurity concentration region of a conductivity type equal to a conductivity type of the high resistance semiconductor layer; and providing an electrode for emitting electrons on the high impurity concentration region.

BRIEF DESCRIPTION OF THE DRAWINGS

The invention will be explained in more detail in conjunction with appended drawings, wherein.

DESCRIPTION OF THE PREFERRED EMBODIMENTS

Before describing a field-emission cathode in the preferred embodiments according to the invention, the aforementioned conventional field-emission cathodes and a method for fabricating the same will be explained.

Figure 1:
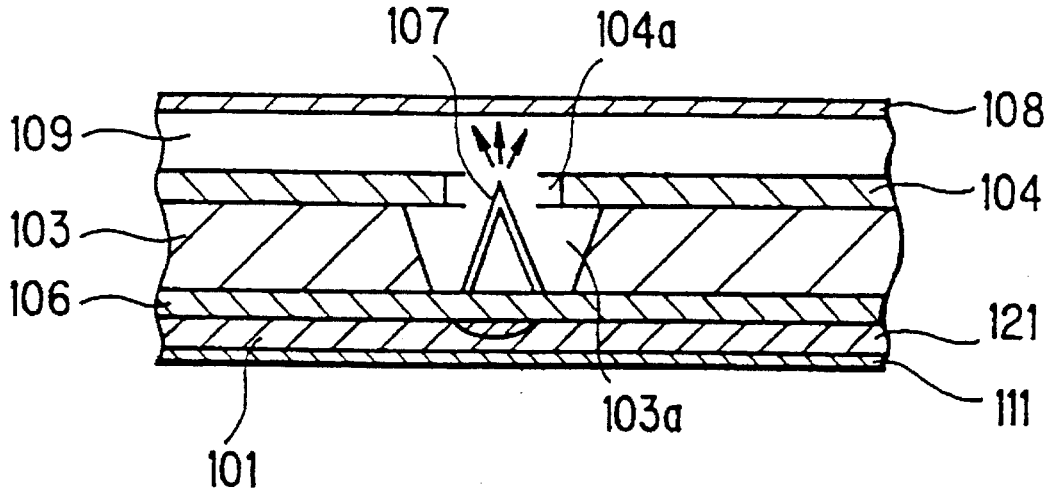
FIG. 1 PRIOR ART
FIG. 1 is a cross-sectional view showing a first conventional field-emission cathode.

FIG. 1 shows the first conventional field-emission cathode of Spindt type which is described in the U.S. Pat. No. 4,940,916 to comprise an insulating substrate 101, a thin insulating film 111 deposited on the insulating substrate 101, an emitter electrode 121 provided on the thin insulating film 111, a resistance layer 106 provided on the emitter electrode 121, a fine cone-shaped emitter 107 having a height of approximately 1 μm formed on the resistance layer 106 by film deposition process, an insulating layer 103 surrounding the emitter by an opening 103*a*, a gate electrode 104 provided on the insulating layer 103 to have an aperture 104*a*, and an anode 108 provided above the gate electrode 104 to be common to the emitter 107 and other emitters (not shown) by a space 109.

In this cathode, the emitter electrode 121 and the emitter 107 are connected electrically, and a voltage of approximately 100 V is applied across the emitter 107 and a gate electrode 104. A thickness of the insulating layer 103 is approximately 1 μm, and a diameter of the aperture 104*a* of the gate electrode 104 is as narrow as approximately 1 μm. A tip of the emitter 107 is extremely sharp to be applied with a large electric field. When the applied electric field is equal to or greater than 2 to $5\times10^7$ v/cm, electrons are emitted from the tip of the emitter 107. When electrons are emitted from the emitter 107, electrons flow into the emitter 107 from the emitter electrode 12 via the resistance layer 106 immediately below the emitter 107. In case of a great amount of electrons emitted therefrom, a voltage-drop across the resistance layer 106 is increased to lower a voltage across the tip of the emitter 107 and the gate electrode 104, so that an amount of electrons to be emitted from the emitter is decreased. Such negative-feed back operation occurs due to a voltage-drop across the both sides of the resistance layer 106. As a result, the change of emission current for each emitter becomes small to improve the uniformity of the emission current.

Figure 2:
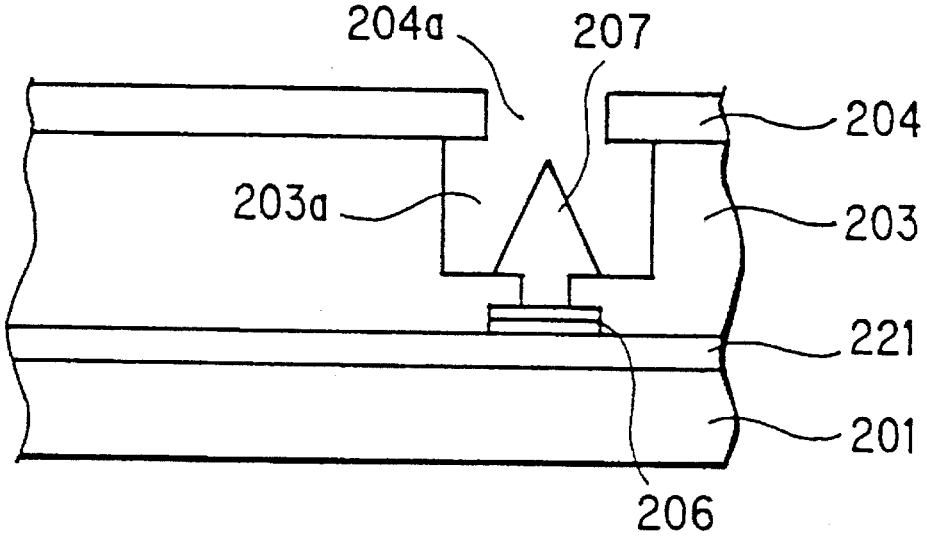
FIG. 2 PRIOR ART
FIG. 2 is a cross-sectional view showing a second conventional field-emission cathode.

FIG. 2 shows the second conventional field-emission cathode which is described in the Japanese Patent Kokai No. 4-249026 to comprise a substrate 201, an emitter electrode 221, an insulating layer 203 having a cavity 203*a*, a gate electrode 204 having an aperture 204*a*, an emitter 207, and a current-constant device 206, wherein an amount of current emitter from the emitter 207 is controlled to be constant by the current-constant device 206.

Figure 3A:
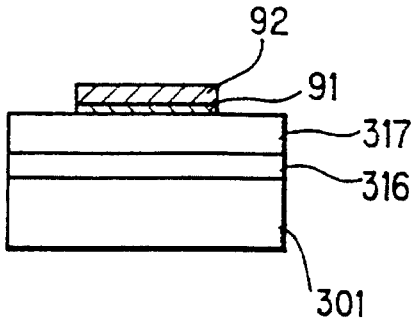
FIG. 3A PRIOR ART
FIGS. 3A to 3C are cross-sectional views showing the steps of a conventional method for fabricating a field-emission cathode.
Figure 3B:
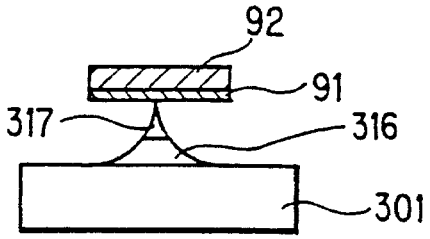
FIG. 3B PRIOR ART
Figure 3C:
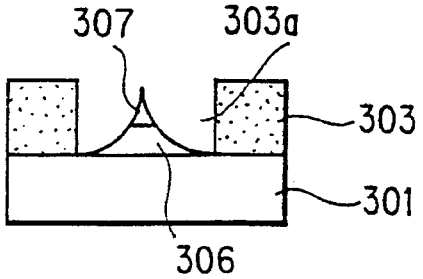
FIG. 3C PRIOR ART

FIG. 3A to 3C show a method for fabricating a field-emission cathode which is described in the Japanese Patent Kokai No. 5-36345. The method comprises the steps of providing a high resistance epitaxial layer 316 and a low resistance epitaxial layer 317 successively on a silicon substrate 301, and providing a two-layer mask of a silicon oxide film 91 and a silicon nitride film 92 on the low resistance epitaxial layer 317, respectively, as shown in FIG. 3A. Then, the method carries out the steps of etching the high and low resistance epitaxial layers 316 and 317 by using the two layer mask as shown in FIG. 3B, and providing an insulating layer 303 having a cavity 303*a* surrounding an emitter 307 formed by the low resistance layer 317 and a resistance layer 306 formed by the high resistance layer 316 by using the two layer mask, and finally removing the two layer mask as shown in FIG. 3C.

In a field-emission cathode thus fabricated, a voltage-drop across the resistance layer 306 is obtained dependent on an amount of emission current to provide the uniformity of the emission current.

Figure 4:
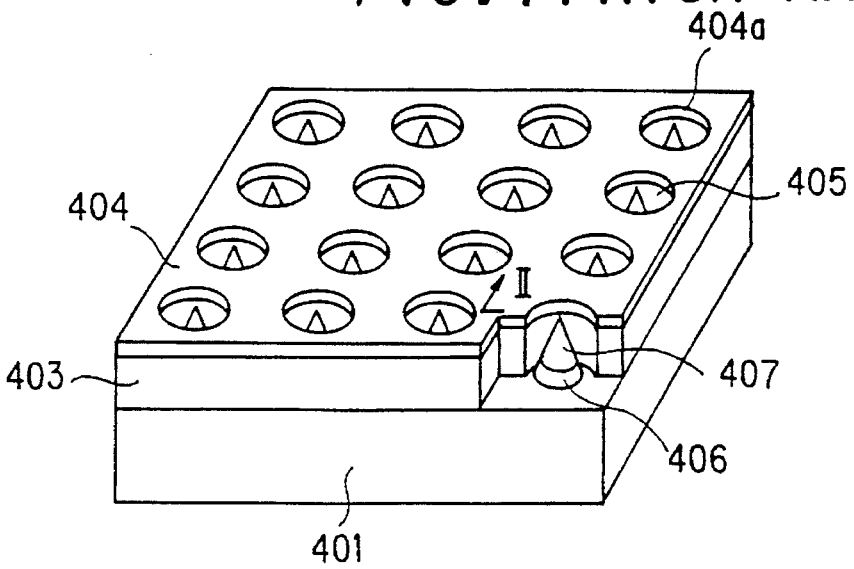
FIG. 4 PRIOR ART
FIG. 4 is a perspective view showing a third conventional field-emission cathode.

FIG. 4 shows the third conventional field-emission cathode which is described in the Japanese Patent Kokai No. 5-47296 to comprise a composite material substrate 401 composed of silicon and molybdenum, a resistance layer 406, a cone-shaped emitter 407 of molybdenum, an insulating layer 403 having a cavity 405, and a gate electrode 404 having an aperture 404*a*.

In the field-emission cathode, a voltage-drop across the resistance layer 406 occurs dependent on an amount of emission current to improve the uniformity of the emission current.

Figure 5:
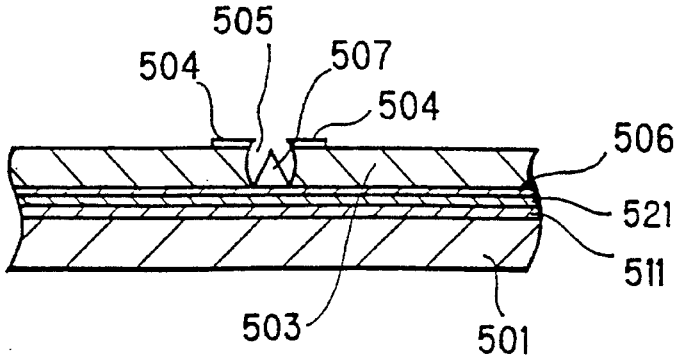
FIG. 5 PRIOR ART
FIG. 5 is a cross-sectional view showing a fourth conventional field-emission cathode.

FIG. 5 shows the fourth conventional field-emission cathode which is described in the Japanese Patent Kokai No. 5-94760 to comprise a glass substrate 501, an emitter electrode 511, a tantalum layer 521, a tantalum oxide layer 506, an insulating layer 503 having a cavity 505, a gate electrode 504, and an emitter 507.

In the field-emission cathode, the tantalum layer 521 is anode-oxidized to provide the tantalum oxide layer 506 having a precise thickness. In accordance with the tantalum oxide layer thus obtained, an emission current-constant property is expected.

Figure 6:
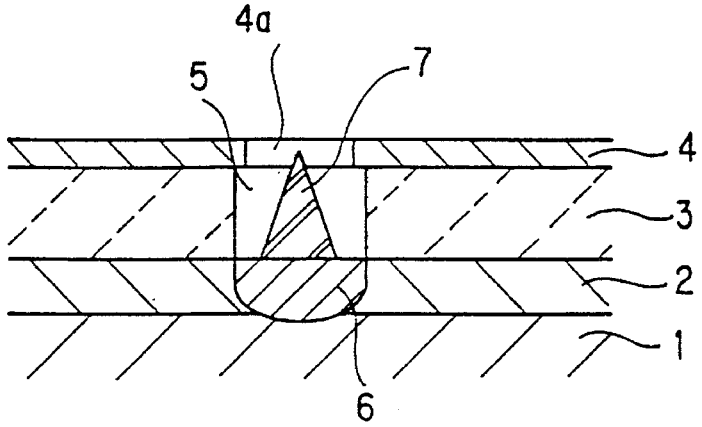
FIGS. 6 to 8 are cross-sectional views showing field-emission cathodes in first to third preferred embodiments according to the invention.

Next, a field- emission cathode in the first preferred embodiment will be explained in FIG. 6.

The field-emission cathode comprises a silicon substrate 1, a high resistance epitaxial layer 2, an insulating layer 3 having a fine cavity 5, a gate electrode 4 having an aperture 4*a*, a resistance layer 6 formed through the epitaxial layer 2 to contact with the substrate 1 and have a width equal to a diameter of the cavity 5, and an emitter 7 provided on the resistance layer 6, wherein the emitter 7 is connected electrically via the resistance layer 6 to the substrate 1. Of course, an anode (not shown) facing the emitter 7 via a space is formed to provide an electron-emission unit which is one of an array of field emission cathodes.

In the field-emission cathode, the emitter 7 is formed from a refractory metal such as tungsten, molybdenum, etc., and the insulating layer 3 is , for instance, of a thermal silicon oxide ($SiO_2$) film. A diameter of the aperture 4*a* is approximately 1 μm, a height of the emitter 2 is approximately 1 μm, a thickness of the insulating layer 3 is approximately 0.8 μm, a thickness of the gate electrode 4 is approximately 0.2 μm, and a thickness of the epitaxial layer 2 is approximately 1 μm. In order to operate the cathode, a voltage of several tens to approximately 100 V is applied to the gate electrode 4 on the basis of a potential of the substrate 1.

An impurity concentration of the epitaxial layer 2 is as low as possible, for instance, lower than $10^{13}/cm^3$, and that of the resistance layer 6 is set to be approximately $10^{14}/cm^3$. For instance, when a resistance layer of the above described concentration is formed by a n-epitaxial layer including phosphor as impurities, a resistivity of the resistance layer is approximately 500 Ω. Therefore, a resistance value of the resistance layer which is cylindrically shaped and has to have a thickness of 1 μm and a diameter of 1 μm is approximately 100 kΩ, so that a voltage-drop of approximately 10 V occurs to limit an emission current or a discharge current, when a current of 100 μA flows therethrough. In this structure, it is necessary that an impurity concentration is higher in the vicinity of the surface of the resistance layer, as indicated in FIG. 6 by the reference numeral 6, than in the remaining portion thereof to provide a stable ohmic contact between the resistance layer 6 and the emitter 7.

In operation, electrons are emitted from the tip of the emitter 7, so that a voltage-drop occurs across both sides of the resistance layer 6 to push a voltage up at the tip of the emitter 7. Thus, a voltage across the emitter 7 and the gate electrode 4 is equivalently lowered. At this time, even if discharge occurs between the gate electrode 4 and the emitter to start the flow of current, the discharge current is limited by the voltage-drop across the both sides of the resistance layer 6. Otherwise, a voltage which is necessary to continue the discharge is not maintained. This results in the ceasing of discharge in a short time. For this reason, the possibility of break-down in the cathode is remarkably lowered.

Figure 7:
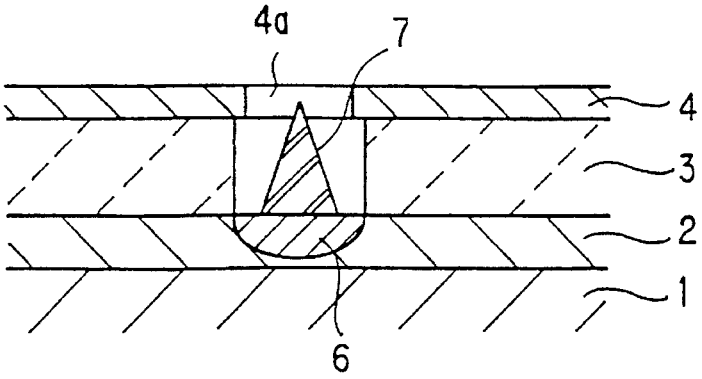

FIG. 7 shows a field-emission cathode in the second preferred embodiment, wherein like parts are indicated by like reference numerals as used in the first preferred embodiment, and dimensions and materials are the same as used in the first preferred embodiment.

In the second preferred embodiment, the resistance layer 6 does not reach the substrate 1 and terminates in the epitaxial layer 2. For this structure, an emission current flows from the emitter 7 through the resistance layer 6 and the epitaxial layer 2 to the substrate 1. As understood in FIG. 7, a thickness of a region of the epitaxial layer 2 sandwiched between the resistance layer 2 and the substrate 1 is sufficiently thin, so that the emitter 7 and other emitters (not shown) are well separated, and a resistance value necessary for a voltage-drop is partially shared by a resistance value of the high resistance epitaxial layer 2. Thus, a higher sensitive current-limitation effect is obtained.

Figure 8:
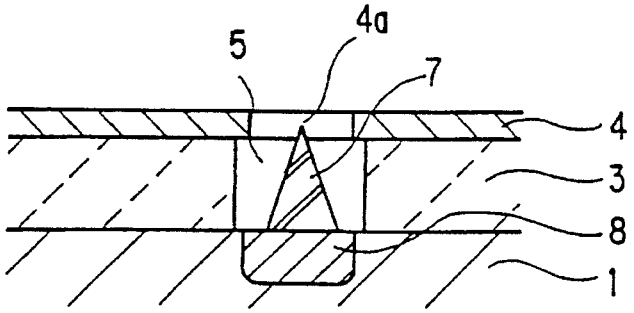

FIG. 8 shows a field-emission cathode in the third preferred embodiment, wherein like parts are indicated by like reference numerals as used in the first preferred embodiment, and dimensions and materials are the same as in the first preferred embodiment.

In the third preferred embodiment, the epitaxial layer 2 is not provided, and the resistance layer 6 is replaced by a p-semiconductor region 8 which is formed in the silicon substrate 1 of n-conductivity type. As clearly shown in FIG. 8, the emitter 7 and the substrate 1 are electrically connected by the p-region 8.

Next, a method for fabrication a field-emission cathode in the first preferred embodiment will be explained in FIG. 9A to 9D.

Figure 9A:
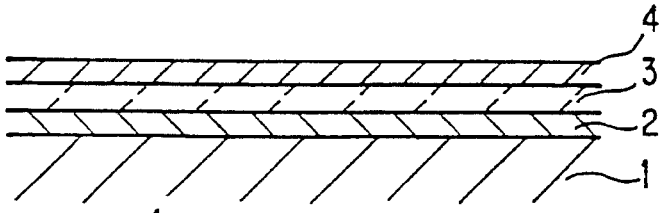
FIGS. 9A to 9D are cross-sectional views showing the steps of a method for fabricating a field-emission cathode in a first preferred embodiment according to the invention.

In FIG. 9A, a high resistance epitaxial layer 2, an insulating layer 3, and a gate electrode are successively formed on a silicon substrate 1.

Figure 9B:
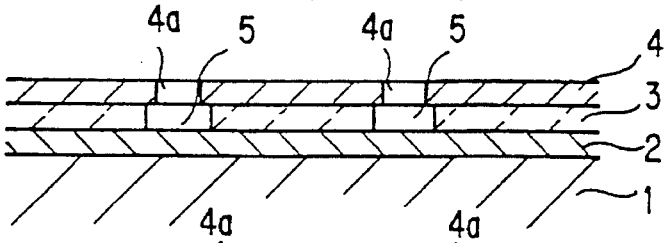

In FIG. 9B, a cavity 5 is formed by removing portions of the insulating layer 3 and the gate electrode 4 by using lithography process.

Figure 9C:
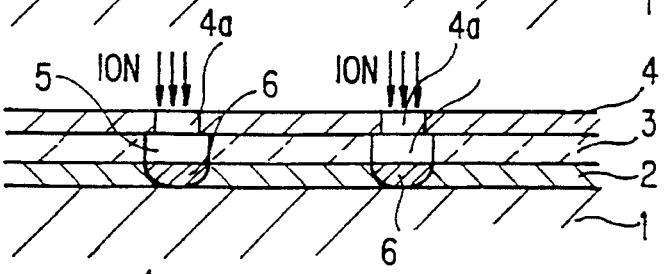

In FIG. 9C, ions of an impurity element assigning the same conductivity to the epitaxial layer 2 as the substrate 1 are injected to the epitaxial layer 2 to provide a resistance layer 6 by using the gate electrode 4 as a mask. At this step, the epitaxial layer 2 is changed in resistance value by the whole thickness or a partial thickness thereof, and it is preferable that the substrate 1 is slanted relative to ion beams injected into the epitaxial layer 2 and is rotated at a predetermined velocity to inject ions over an area of the epitaxial layer 2 which is wider than an aperture 4*a* of the gate electrode 4. For instance, phosphor ions of n-conductivity type are injected into a n-epitaxial layer 2 to provide a phosphor ion concentration of $10^{14}/cm^3$ by applying three-step energies of 600 keV, 800 keV and 1,000 keV to the ions.

Figure 9D:
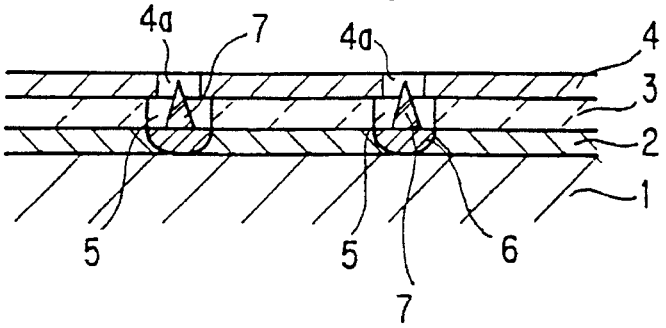

In FIG. 9D, an acceleration voltage for ion beams is lowered less than 50 keV to inject a great amount of ions, so that an upper surface region of the resistance layer 6 is made higher in impurity concentration to provide a stable contact between an emitter 7 and the resistance layer 6. The emitter 7 is formed on the resistance layer 6 by well known vapor-phase deposition.

As described above, only processes for epitaxial layer growth and ion injection are required to simplify the method for fabricating a field-emission cathode. In other words, no step to form a fine structure is added to the above described steps, wherein a resistance layer is provided in a conventional basic structure.

The above described steps are applied to fabrication of field-emission cathodes in the first to third preferred embodiments, wherein the resistance layer 6 and the p-region 8 are formed in self-alignment to obviate the positioning of a mask necessitating high precision.

In the preferred embodiments, the high resistance semiconductor epitaxial layer 2 is replaced by one of a high resistance polycrystalline layer such as polysilicon layer, and a semiconductor layer such as an amorphous layer.

Although the invention has been described with respect to specific embodiments for complete and clear disclosure, the appended claims are not to be thus limited but are to be construed as embodying all modification and alternative constructions that may occur to one skilled in the art which fairly fall within the basic teaching herein set forth.

What is claimed is:

1. A field-emission cathode, comprising:

a semiconductor substrate;

a high resistance semiconductor layer formed on said semiconductor substrate;

an electrode for emitting electrons, said emitting electrode being provided on said high resistance semiconductor layer and having a sharpened tip;

an insulating layer formed on said high resistance semiconductor layer, said insulating layer having a cavity surrounding said emitting electrode; and a control electrode provided on said insulating layer, said control electrode having an aperture surrounding said emitting electrode;

said high resistance semiconductor layer having a cylindrically shaped lower resistivity region located under said emitting electrode, wherein an impurity concentration of said region under said emitting electrode is higher than in a remaining region of said high resistance semiconductor layer;

wherein said high resistance semiconductor layer is one of an epitaxial layer, a polycrystalline layer, and an amorphous layer; and wherein the impurity concentration of said region under said emitting electrode is higher in an upper surface region thereof than in a remaining region of said lower resistivity region.

* * * * *